US005582353A

United States Patent [19]

Willibald

[11] Patent Number: 5,582,353

[45] Date of Patent: Dec. 10, 1996

[54] CUTTER BODY

[75] Inventor: Artur Willibald, Überlingen, Germany

[73] Assignee: Ahwi Maschinenbau GmbH, Germany

[21] Appl. No.: 416,796

[22] PCT Filed: Aug. 4, 1994

[86] PCT No.: PCT/EP94/02582

§ 371 Date: Apr. 12, 1995

§ 102(e) Date: Apr. 12, 1995

[87] PCT Pub. No.: WO95/05273

PCT Pub. Date: Feb. 23, 1995

[30] Foreign Application Priority Data

Aug. 14, 1993 [DE] Germany ..... 43 27 120.0

[51] Int. Cl.[6] ..... B02C 18/18

[52] U.S. Cl. ..... 241/294

[58] Field of Search ..... 241/197, 195, 241/194, 293, 294, 295

[56] References Cited

U.S. PATENT DOCUMENTS

| | | | |
|---|---|---|---|
| 2,558,107 | 6/1951 | Smith | 241/194 |
| 2,822,138 | 2/1958 | Olive | 241/194 |
| 3,286,894 | 11/1966 | Mason . | |
| 3,455,517 | 7/1969 | Gilbert . | |
| 4,036,095 | 7/1977 | Huber et al. . | |
| 4,077,450 | 3/1978 | Ackerman . | |
| 4,136,833 | 1/1979 | Knight | 241/194 |
| 4,946,109 | 8/1990 | Lewis . | |
| 5,205,667 | 4/1993 | Montgomery | 241/194 X |

FOREIGN PATENT DOCUMENTS

| | | | |
|---|---|---|---|
| 3636816 | 5/1988 | Germany . | |
| 3545708 | 1/1994 | Germany . | |
| 1269831 | 11/1986 | U.S.S.R. | 241/194 |

*Primary Examiner*—Mark Rosenbaum
*Attorney, Agent, or Firm*—Speckman, Pauley & Fejer

[57] ABSTRACT

A cylindrical cutter body with base elements fitted to a cutter body surface. The base elements project out from the cutter body surface. A cutter holder carrying at least one cutter plate can be attached to each base element. This invention increases the lifetime of the cutter body, while at the same time simplifying replacement of the cutter holder because the cutter holder is connected to the base element by a rotational fitting, the axis of the rotational fitting being parallel or inclined to the rotational axis of the cutter body, and rotational distortion between the cutter holder and the base element is restricted in the opposite direction to the direction of rotation of the cutter body by a stop on the cutter holder or base element.

16 Claims, 2 Drawing Sheets

CUTTER BODY

BACKGROUND OF THE INVENTION

1. Field of the Invention

This invention relates to a cylindrical cutter body that has base elements that project from the cutter body surface. A cutter holder supporting a cutter plate can be positioned on each base element.

2. Description of Prior Art

Conventional cutter bodies in the form of motor-driven rotating tools are used, for example, for comminuting bushes branches, and the like The base elements have a blind-bore-like receiver that has a square cross section. A neck of the cutter holder, whose cross section is conformingly designed, is inserted and fixed therein. Because of the greatly fluctuating, shock-like load variations acting on the cutter plates during operation, the insertion areas of the receivers become widened over time. Thus, the neck develops free play, and the receiver easily catches and the base element must be replaced.

The base elements are generally welded to the cutter body, and thus their replacement is very complicated and cost-intensive.

SUMMARY OF THE INVENTION

It is one object of this invention to produce a cutter body of the above-mentioned type in which the base elements and the cutter holders have an extended service life, even when subjected to relatively high load shocks, and wherein the cutter holders can be simply and easily replaced.

This object and others are achieved in accordance with the invention in that the cutter holder can be connected with the base element by a pivot bearing. An axis of the pivot bearing is preferably oriented parallel to or at an angle with the axis of rotation of the cutter body. Twisting between the cutter holder and the base element opposite with respect to the direction of rotation of the cutter body is limited by a stop of the cutter holder or the base element.

The base element remains fixedly connected to the cutter body. During assembly, the cutter holder is simply rotatably seated in the base element and is held in a defined position because of twisting motion during operation.

Thus, seating free play has been eliminated in a simple manner, even under shock-like loads. If there is play between the base element and the cutter holder, for example because of incorrect assembly, the cutter holder is centered at the first engagement movement with the material to be chopped because of the twisting motion at contact. Freedom from play is assured in this way.

In accordance with one preferred embodiment of this invention, the cutter holder is formed in the shape of a drumstick, wherein two parallel legs spaced apart from each other are formed on a body, and a receiver is formed between the legs. The base element can be introduced into the receiver and rotatably connected to the legs. The cutter holder can be easily mounted, and an even force transfer from the cutter holder to the base element is achieved.

A cost-effective design of the pivot bearing is achieved because the pivot bearing includes a fastening screw and two screw receivers of the base element. The cutter holder is aligned with the two screw receivers, and the fastening screw is inserted into the screw receivers and secured by a nut. The cutter holder and the base element can be clamped together, in this manner. Thus, rotation in the pivot bearing occurs only after application of a sufficient force, so that the cutter holders do not rotate away from the stop under their own weight.

A compact and small construction of a cutter body is achieved in that a shoulder is positioned on the base element in the direction parallel to the operational direction of the cutter body. A stop is formed at the back of the base element opposite the operational direction of the cutter, at the end of the shoulder and at approximately a right angle to the shoulder. The back of the base element preferably has a recess, and the front of the base element has a projection. The projection matches the recess of an adjacent base element.

Thus, the individual base elements can be aligned closely adjacent to each other. The cutter plates fastened on the cutter holders are also positioned close together, so that a close cutting geometry can be generated.

According to another preferred embodiment of this invention, several cutter plates are positioned next to each other in the axial direction of the cutter body in a groove of the cutter holder.

Secure fastening of the individual cutter plates along with a defined orientation of the cutter plates on the cutter holder is achieved with a groove that is cut into the cutter holder, and into which the cutter plates are inserted and soldered.

In accordance with one preferred embodiment of this invention, a free space, inclined in the direction toward the cutting center of the cutter body, adjoins the groove of the cutter holder opposite the direction of operation of the cutting body.

Depending on the angle of inclination, various options of using the cutter body are possible. A variation of the angle of inclination can also be achieved if, for example, the stop can be adjusted and fixed in place.

If a base of the base element is welded to the cutter body surface, the base element can be easily positioned on the cutter body and welded to it. The prefabricated pocket receivers assure a definite orientation of the base element and therefore an orientation of the rotational axis of the pivot bearing which is axially parallel or angled with respect to the axis of rotation of the cutter body.

If the cutter holders are manufactured in large numbers, the cutter holder can be made of cast iron.

According to another preferred embodiment of this invention, the base elements are directly lined up with each other and form a continuous cutting spiral so that the cutter body moves the comminuted material to the outside.

BRIEF DESCRIPTION OF THE DRAWINGS

This invention will be explained in detail in conjunction with the drawings, wherein.

DESCRIPTION OF PREFERRED EMBODIMENTS

Figure 1:
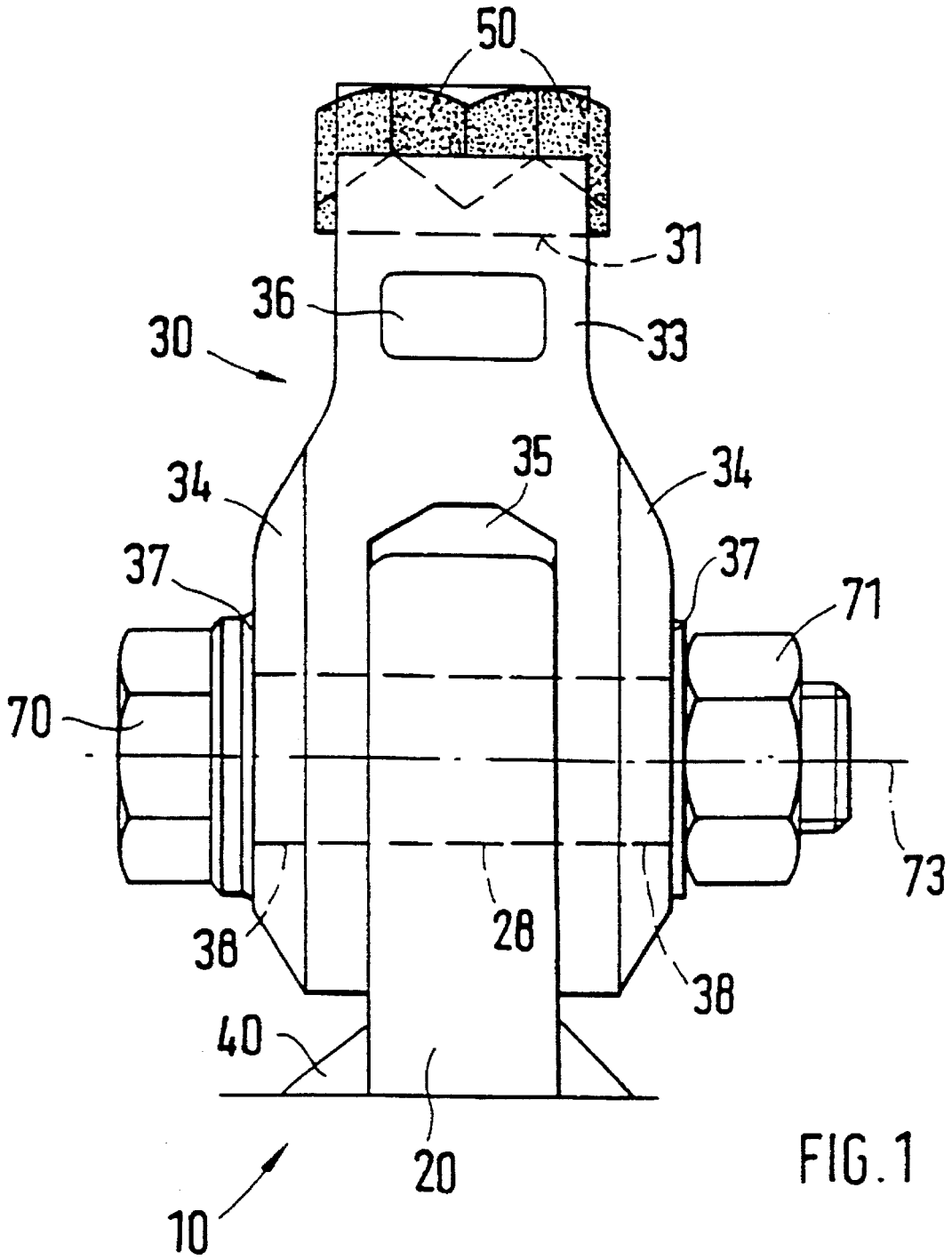
FIG. 1 shows a front view of a base element with a mounted cutter holder according to one preferred embodiment of this invention.

A base element 20 is illustrated in FIG. 1. The base element 20 is connected with the cutter body 10 by welding beads 40. The base element 20 projects at right angles from the surface of the cutter body 10 and has a screw receiver 28. The receiver 28 has a bore axis 73 aligned axially parallel to the axis of rotation of the cutter body 10. A cutter holder 30 has been positioned on the base element 20. The cutter holder 30 comprises a body 33, on which two downwardly projecting legs 34, spaced apart and parallel to each other, have been formed as one piece. Legs 34 have screw receivers 38 that are aligned with the screw receiver 28 of the base element 20.

A receptacle 35 is formed between the legs 34. The width of the receptacle 35 is adapted to the width of the base element 20, so that the cutter holder 30 can be easily positioned on the base element 20, and the screw receivers 38 of the cutter holder 30 can align with the screw receivers 28 of the base element 20.

A fastening screw 70 is positioned in the screw receivers 28, 38 and secured with a nut 71. The screw head and the nut 71 are supported on a collar 37 of the cutter holder 30. The fastening screw 70, the nut 71, the screw receiver 28 of the base element 20, the screw receivers 38 of the legs, and the cutter holder 30 form a pivot bearing which is rotatable around the bore axis 73. A groove 31 has been cut into the front of the free end of the cutter holder 30. According to one preferred embodiment of this invention, two adjoining cutter plates 50 can be inserted into groove 31 and soldered therein.

A marker field 36 is preferably positioned below the groove 31, in which the type of cutter holder 30 and/or the cutter plates 50 used can be coded.

Figure 2:
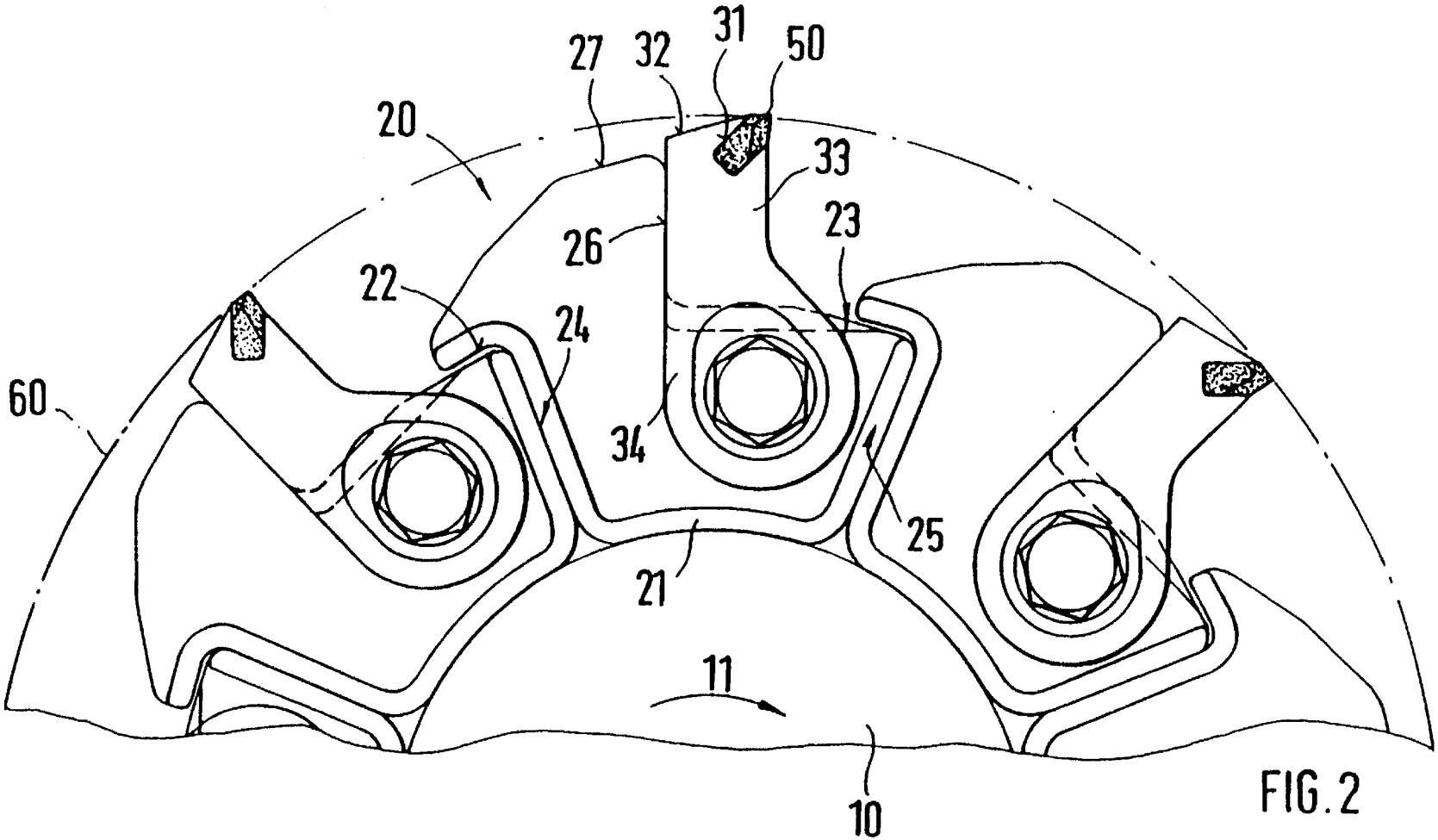
FIG. 2 shows a partial side view of a cutter body with base elements equally distributed thereon, which has cutter holders projectingly fastened on the base elements.

A side view of a cutter body 10 is shown in FIG. 2. On the surface of cutter body 10 base elements 20 have been projectingly provided at equal distances from each other. The base elements 20 are arranged offset with respect to each other in the direction toward the axis of rotation of the cutter body 10, so that the pivot bearing can continue to extend parallel to the axis of rotation of the cutter body 10. Such design simplifies the manufacture of the base element 20 and the cutter holders 30.

The individual base elements 20 are preferably similar to each other and have a recess 22 on the backs 24 of the base elements 20. The recess 22 preferably closely conforms to the front 25 of an adjacent base element 20, so that individual base elements 20 can be positioned closely one behind the other and form a continuous cutting spiral, for example. The axes of rotation of the cutter holder 30 are then preferably placed at an angle with respect to the axis of rotation of the cutter body 10 and therefore perpendicular to the exterior of the base elements 20. The base element 20 is preferably constructed by flame cutting, cutting, or any other process known to those skilled in the art, from a flat material, for example a steel plate. A shoulder 23 is formed from the direction of the front 25. In the direction opposite to the running direction 11 of the cutter body 10, the shoulder 23 makes a transition into a stop 26, against which the back of the cutter holder 30 comes to rest. Adjoining the stop 26, the base element 20 is provided with a slope 27 inclined toward the axis of rotation of the cutter body 10, which eases the removal of the comminuted materials.

The cutting edges of the cutter plates 50 define a cutting circle 60 which is concentric with the axis of rotation of the cutter body 10. A free area 32, inclined toward the axis of rotation of the cutter body 10, is formed on the cutter holder 30 adjoining the cutting edges. The cutter holder 30 can be mounted on the base element 20 by clamping the two legs 34 to the exterior of the base element 20 by the fastening screw 70 and the nut 71. Thus, the cutter holder 30 can only be twisted with respect to the base element 20 in the pivot bearing by a predefined force.

I claim:

1. In a cylindrical cutter body having at least one base element projecting from a cutter body surface, the at least one base element connected to at least one cutter holder, the at least one cutter holder supporting at least one cutter plate, the improvement comprising:

the at least one cutter holder (30) rotatably connected with the at least one base element (20) by a pivot bearing, a pivot bearing axis (73) oriented one of parallel to and at an angle with an axis of rotation of the cutter body (10), a rotational movement of the at least one cutter holder (30) with respect to the at least one base element (20) in a direction opposite with respect to a direction of rotation of the cutter body (10) is limited by a stop (26) of one of the at least one cutter holder (30) and the at least one base element (20), the at least one base element (20) comprises a shoulder (23), the shoulder (23) positioned parallel with respect to a direction of rotation of the cutter body (10), and the stop (26) positioned on an end of the shoulder (23), and the stop (26) positioned generally perpendicular to the shoulder (23).

2. In a cutter body in accordance with claim 1, wherein the at least one cutter holder (30) forms an overall shape of a drumstick, two legs (34) positioned a distance from each other and generally parallel to each other extend from a body (33) of the at least one cutter holder (30), the two legs (34) have a receiver (35), the at least one base element (20) is positioned in the receiver (35), and the at least one base element (20) is rotatably fixed with respect to the two legs (34).

3. In a cutter body in accordance with claim 2, wherein the pivot bearing comprises a fastening screw (70), the at least one base element (20) having a base screw receiver (28), one of the two legs (34) having a first leg screw receiver (38), the other of the two legs having a second leg screw receiver (38), and the fastening screw (70) is positioned in the base screw receiver (28), the first leg screw receiver (38), and the second leg screw receiver (38), and the fastening screw (70) is secured by a nut (71).

4. In a cutter body in accordance with claim 1, wherein the cutter holder (30) has a first leg and a second leg, the first leg is spaced a distance from and generally parallel to the second leg, the pivot bearing comprises a fastening screw (70), the at least one base element (20) having a base screw receiver (28), the first leg having a first leg screw receiver (38), the second leg having a second leg screw receiver (38), and the fastening screw (70) is positioned in the base screw receiver (28), the first leg screw receiver (38), and the second leg screw receiver (38), and the fastening screw (70) is secured by a nut (71).

5. In a cutter body in accordance with claim 1, wherein the at least one cutter holder (30) forms a groove (31) and the at least one cutter plate (50) is fixedly secured in the groove (31).

6. In a cutter body in accordance with claim 1, wherein a plurality of cutter plates (50) are positioned adjacent each other in an axial direction of the cutter body (10) in a groove (31).

7. In a cutter body in accordance with claim 1, wherein the at least one base element (20) comprises a base (21), and the base (21) is fixedly secured to the cutter body surface.

8. In a cutter body in accordance with claim 1, wherein a plurality of base elements (20) are positioned adjacent each other radially about the cutter body, and form a continuous cutting signal.

9. In a cylindrical cutter body having at least one base element projecting from a cutter body surface, the at least one base element connected to at least one cutter holder, the at least one cutter holder supporting at least one cutter plate, the improvement comprising:

the at least one cutter holder (30) rotatably connected with the at least one base element (20) by a pivot bearing, a pivot bearing axis (73) oriented one of parallel to and at an angle with an axis of rotation of the cutter body (10), a rotational movement of the at least one cutter holder (30) with respect to the at least one base element (20) in a direction opposite with respect to a direction of rotation of the cutter body (10) is limited by a stop (26) of one of the at least one cutter holder (30) and the at least one base element (20), the at least one cutter holder (30) forming an overall shape of a drumstick, two legs (34) positioned a distance from each other and generally parallel to each other extending from a body (33) of the at least one cutter holder (30), the two legs (34) having a receiver (35), the at least one base element (20) positioned in the receiver (35), and the at least one base element (20) rotatably fixed with respect to the two legs (34), the pivot bearing comprising a fastening screw (70), the at least one base element (20) having a base screw receiver (28), one of the two legs (34) having a first leg screw receiver (38), the other of the two legs having a second leg screw receiver (38), the fastening screw (70) positioned in the base screw receiver (28), the first leg screw receiver (38), and the second leg screw receiver (38), and the fastening screw (70) secured by a nut (71), and the at least one base element (20) having a recess (22) on a back portion (26) of the at least one base element (20), a projection positioned on a front portion of the at least one base element (20), and an overall shape of the projection conforming to an overall shape of the recess (22).

10. In a cutter body in accordance with claim 9, wherein the at least one cutter holder (30) forms a groove (31) and the at least one cutter plate (50) is fixedly secured in the groove (31).

11. In a cutter body in accordance with claim 10, wherein a plurality of cutter plates (50) are positioned adjacent each other in an axial direction of the cutter body (10) in the groove (31).

12. In a cutter body in accordance with claim 7, wherein the at least one cutter holder (30) has a slanted end portion adjacent the groove (31) in a position with respect to groove (31) opposite to a direction of rotation of an operating cutting body (10), and the slanted end portion slants generally from the groove (31) toward a center of the cutting body (10).

13. In a cutter body in accordance with claim 12, wherein the at least one base element (20) comprises a base (21), and the base (21) is fixedly secured to the cutter body surface.

14. In a cutter body in accordance with claim 13, wherein the at least one cutter holder (30) is constructed from cast iron.

15. In a cutter body in accordance with claim 14, wherein a plurality of base elements (20) are positioned adjacent each other radially about the cutter body, and form a continuous cutting spiral.

16. In a cylindrical cutter body having at least one base element projecting from a cutter body surface, that at least one base element connected to at least one cutter holder, the at least one cutter holder supporting at least one cutter plate, the improvement comprising:

the at least one cutter holder (30) rotatably connected with the at least one base element (20) by a pivot bearing, a pivot bearing axis (73) oriented one of parallel to and at angle with an axis of rotation of the cutter body (10), a rotational movement of that at least one cutter holder (30) with respect to the least one base element (20) in a direction opposite with respect to a direction of rotation of the cutter body (10) is limited by a stop (20) of one of the least one cutter holder (30) and the at least one base element (20), and at least one base element (20) having a recess (22) on a back portion (26) of the at least one base element (20), a projection positioned on a front portion of the at least one base element (20), and an overall shape of the projection comforming to and overall shape of the recess (22).

* * * * *